US009132559B2

(12) United States Patent
Hatch et al.

(10) Patent No.: US 9,132,559 B2
(45) Date of Patent: Sep. 15, 2015

(54) CUTLERY HAVING IMPROVED GRIPPING ERGONOMICS

(75) Inventors: Paul Hatch, Chicago, IL (US); Clifford Krapfl, Chicago, IL (US); Julia Burke, Chicago, IL (US); Thomas Mitchell, Chicago, IL (US); David Mucci, Chicago, IL (US)

(73) Assignee: WKI Holding Company, Inc., Rosemont, IL (US)

( * ) Notice: Subject to any disclaimer, the term of this patent is extended or adjusted under 35 U.S.C. 154(b) by 0 days.

(21) Appl. No.: 13/322,839

(22) PCT Filed: May 27, 2010

(86) PCT No.: PCT/US2010/036460

§ 371 (c)(1),
(2), (4) Date: Nov. 28, 2011

(87) PCT Pub. No.: WO2010/138753

PCT Pub. Date: Dec. 2, 2010

(65) Prior Publication Data

US 2012/0079725 A1 Apr. 5, 2012

Related U.S. Application Data

(60) Provisional application No. 61/181,404, filed on May 27, 2009.

(51) Int. Cl.
*B26B 3/00* (2006.01)
*B26B 29/02* (2006.01)

(52) U.S. Cl.
CPC .. *B26B 3/00* (2013.01); *B26B 29/02* (2013.01)

(58) Field of Classification Search
CPC ..... B26B 3/00; B26B 3/02; B25G 1/00; B25G 3/00; B25G 3/02
USPC ..... 30/295, 340, 342, 344, 286; D7/649
See application file for complete search history.

(56) References Cited

U.S. PATENT DOCUMENTS

D22,700 S 8/1893 Smith
D110,283 S 6/1938 Goodrich
(Continued)

FOREIGN PATENT DOCUMENTS

DE 3932050 A1 4/1991
DE 102004052681 A1 * 9/2005
(Continued)

OTHER PUBLICATIONS

International Search Report & Written Opinion for PCT/US2010/036460, Aug. 24, 2010.

*Primary Examiner* — Jason Daniel Prone
(74) *Attorney, Agent, or Firm* — McDermott Will & Emery LLP

(57) ABSTRACT

A knife for cutting food products having a proximal end, a distal end and a length defined therebetween. The knife includes a blade portion having a cutting edge and a spine disposed on a top side of the blade portion and generally opposed to the cutting edge. The knife includes a handle portion disposed proximal of the blade portion with a top surface and a bottom surface, a first end proximal to the blade portion and a second end distal to the blade portion. The handle portion includes a bolster section with at least a first thickness, a first lateral sidewall and a second lateral sidewall. The bolster section is disposed at the first end of the handle portion and adjacent to the blade portion. The first sidewall of the bolster section includes an arcuate proximal bolster boundary defined by a curvilinear ridge extending downwardly toward the blade portion from a point proximate the top surface of the handle portion. The first sidewall of the bolster section also includes an arcuate distal bolster boundary being defined by a curvilinear ridge extending downwardly toward the blade portion from a point proximate the bottom surface of the handle portion. A portion of the curvilinear ridge defining the arcuate proximal bolster boundary is spaced a distance along the length of the knife from a portion of the curvilinear ridge defining the arcuate distal boundary. A surface depression is formed in at least one of the first lateral sidewall and the second lateral sidewall, the surface depression being disposed between the curvilinear ridge defining the arcuate proximal bolster boundary.

4 Claims, 7 Drawing Sheets

(56) References Cited

U.S. PATENT DOCUMENTS

| | | | | | |
|---|---|---|---|---|---|
| D136,445 | S | | 10/1943 | Gerber | |
| 2,390,544 | A | * | 12/1945 | Lamb | D7/649 |
| D149,814 | S | * | 6/1948 | Hvale et al. | D7/649 |
| 2,492,096 | A | | 12/1949 | Juengst | |
| D173,114 | S | * | 9/1954 | Lamb | D7/649 |
| D173,115 | S | * | 9/1954 | Lamb | D7/649 |
| D173,116 | S | * | 9/1954 | Lamb | D7/649 |
| D173,117 | S | * | 9/1954 | Lamb | D7/649 |
| D182,290 | S | * | 3/1958 | Lamb | D7/649 |
| D182,291 | S | * | 3/1958 | Lamb | D7/649 |
| D182,292 | S | * | 3/1958 | Lamb | D7/649 |
| D182,293 | S | * | 3/1958 | Lamb | D7/649 |
| D186,021 | S | * | 9/1959 | Lamb | D7/649 |
| 2,907,108 | A | * | 10/1959 | Nolte, Jr. | D7/649 |
| D195,951 | S | * | 8/1963 | Wildgen | D7/649 |
| D202,780 | S | * | 11/1965 | Near | D22/118 |
| 3,481,038 | A | * | 12/1969 | Cooper | 30/344 |
| 3,568,315 | A | * | 3/1971 | Smith | 30/161 |
| D230,126 | S | | 1/1974 | Pollard | |
| 3,900,950 | A | * | 8/1975 | Collins | 30/342 |
| D236,579 | S | * | 9/1975 | Morback | D7/649 |
| D240,495 | S | * | 7/1976 | Koppe | D7/649 |
| 4,215,472 | A | * | 8/1980 | Raven | 30/164.95 |
| 4,240,201 | A | * | 12/1980 | Sawby et al. | 30/161 |
| D269,244 | S | * | 6/1983 | Becher et al. | D7/650 |
| 4,578,864 | A | * | 4/1986 | Hoffman | 30/295 |
| 4,712,304 | A | * | 12/1987 | Sanelli | D7/649 |
| D296,179 | S | | 6/1988 | Hagberg et al. | |
| D309,557 | S | * | 7/1990 | Quennessen | D7/649 |
| D316,015 | S | | 4/1991 | DiGangi | |
| D337,022 | S | * | 7/1993 | Sheets | D7/649 |
| D358,529 | S | * | 5/1995 | Rich | D7/401.2 |
| 5,528,834 | A | * | 6/1996 | Seber et al. | 30/340 |
| D372,635 | S | * | 8/1996 | Gebhardt | D7/649 |
| D377,296 | S | * | 1/1997 | Roberts | D7/649 |
| D402,856 | S | * | 12/1998 | Cohen et al. | D7/649 |
| D403,556 | S | | 1/1999 | Juhlin et al. | |
| D405,314 | S | | 2/1999 | Kroscher et al. | |
| D413,232 | S | * | 8/1999 | Conner | D7/649 |
| 5,975,909 | A | * | 11/1999 | Ritchie | 30/322 |
| D424,380 | S | * | 5/2000 | McCatty | D7/649 |
| D425,365 | S | * | 5/2000 | Chien | D7/401.2 |
| 6,254,293 | B1 | * | 7/2001 | Citrenbaum | 30/340 |
| D458,511 | S | | 6/2002 | Rorke | |
| D461,374 | S | * | 8/2002 | Sylva et al. | D7/650 |
| 6,460,256 | B2 | * | 10/2002 | Peppel et al. | 30/340 |
| 6,502,314 | B1 | * | 1/2003 | McCatty | 30/340 |
| D474,655 | S | | 5/2003 | Schmidt | |
| 6,598,302 | B1 | * | 7/2003 | Peppel et al. | 30/340 |
| 6,701,624 | B1 | * | 3/2004 | White | 30/295 |
| D497,522 | S | * | 10/2004 | Reichenbach et al. | D7/649 |
| D498,120 | S | * | 11/2004 | Deglon | D7/649 |
| D503,540 | S | | 4/2005 | Barber | |
| D533,620 | S | * | 12/2006 | Holbl | D22/118 |
| D538,103 | S | | 3/2007 | Tetreault et al. | |
| D540,627 | S | | 4/2007 | Tarrerias | |
| 7,228,632 | B2 | * | 6/2007 | Fedor et al. | 30/340 |
| D554,428 | S | * | 11/2007 | Smith et al. | D7/401.2 |
| 7,322,113 | B2 | * | 1/2008 | Tetreault et al. | 30/298.4 |
| 7,647,701 | B1 | * | 1/2010 | Mollick et al. | 30/155 |
| D617,153 | S | * | 6/2010 | Genberg et al. | D7/649 |
| D623,483 | S | * | 9/2010 | Gerlach | D7/649 |
| D639,614 | S | * | 6/2011 | Krapfl et al. | D7/649 |
| D639,615 | S | * | 6/2011 | Krapfl et al. | D7/649 |
| D639,616 | S | * | 6/2011 | Krapfl et al. | D7/649 |
| D653,507 | S | * | 2/2012 | Henn et al. | D7/649 |
| D658,016 | S | * | 4/2012 | Grass | D7/649 |
| D660,096 | S | * | 5/2012 | Chen | D7/649 |
| D693,173 | S | * | 11/2013 | Chen | D7/649 |
| D693,642 | S | * | 11/2013 | Chen | D7/649 |
| D713,215 | S | * | 9/2014 | Bird | D7/649 |
| 8,839,524 | B2 | * | 9/2014 | Owens | 30/340 |
| D718,978 | S | * | 12/2014 | Chen | D7/649 |
| D719,405 | S | * | 12/2014 | Miller | D7/649 |
| D721,537 | S | * | 1/2015 | Schmidt | D7/649 |
| 2002/0170184 | A1 | * | 11/2002 | Lothe | 30/295 |
| 2004/0123471 | A1 | | 7/2004 | Onion | |
| 2005/0115083 | A1 | * | 6/2005 | Lauridsen | 30/340 |
| 2006/0117576 | A1 | * | 6/2006 | Demers et al. | 30/340 |
| 2006/0207109 | A1 | * | 9/2006 | Numata | 30/342 |
| 2007/0214651 | A1 | * | 9/2007 | Thun | 30/142 |
| 2008/0307655 | A1 | * | 12/2008 | Laub | 30/142 |
| 2010/0325901 | A1 | * | 12/2010 | Catalano et al. | 30/340 |
| 2012/0124844 | A1 | * | 5/2012 | Droese | 30/314 |
| 2012/0159793 | A1 | * | 6/2012 | Hatch et al. | 30/340 |

FOREIGN PATENT DOCUMENTS

| | | | | |
|---|---|---|---|---|
| DE | 102007024374 | A1 | * | 11/2008 |
| EP | 0429035 | A2 | | 5/1991 |
| EP | 1669168 | A1 | * | 6/2006 |
| FR | 2886876 | A1 | * | 12/2006 |
| FR | 2956609 | A3 | * | 8/2011 |
| WO | WO-2005039834 | A1 | | 5/2005 |
| WO | WO 2010138752 | A1 | * | 12/2010 |
| WO | WO 2010138753 | A1 | * | 12/2010 |

* cited by examiner

CUTLERY HAVING IMPROVED GRIPPING ERGONOMICS

RELATED APPLICATIONS

This application is a national phase application of, claims priority from, and incorporates the disclosure of PCT Application No. PCT/US2010/036460 filed May 27, 2010, which claims priority to U.S. Provisional Application No. 61/181,404 filed May 27, 2009.

TECHNICAL FIELD

The present disclosure relates generally to cutlery devices such as knives and more specifically to knives with ergonomically styled handles to promote grasping of a knife in a manner to provide better control of a blade.

BACKGROUND OF THE INVENTION

Knives are one of the most frequently used cutlery devices found in a kitchen. Knives may be utilized for a variety of cutting operations such as slicing, chopping, paring, peeling, and other tasks. As these tasks utilize different motions with a knife, a variety of knives are typically found in a kitchen, such as butcher's knives, chef's knives, paring knives, bread knives, steak knives, and the like. FIG. 1 shows an existing chef's knife 10. The chef's knife 10 has a blade portion 12 and a handle portion 14. The knife 10 has a point A at a distal end of the blade portion 10 that may be used to pierce an item being cut. A tip region B is also found on the blade portion 12. The tip B is usually associated with about one-third of the blade portion 12 at the distal end. The tip B is typically used for smaller cutting tasks, and may be referred to as belly or curve of the chef's knife 10. An edge C is provided on one side of the blade portion 12. The edge C is the cutting surface of the knife 10. The edge C may be beveled or symmetric. A heel D is provided near a proximal end of the blade portion 12. The heel D is a portion of the edge C typically used for cutting activities that require a large amount of force. A spine E is disposed on a side of the blade portion 12 opposite of the edge C. The spine E is typically thicker than the edge C and provides weight and strength to the blade portion 12. A bolster F is provided at a transition of the blade portion 12 to the handle portion 14. The bolster F is typically thicker than the blade portion 12 and adds weight and balance to the knife 10. The bolster F additionally provides an area to prevent a user's hand from slipping on the knife 10. The bolster F has a finger guard G. The finger guard G is provided to help prevent a user's hand from slipping onto the blade portion 12. Finally, the blade portion 12 includes a return H. The return H is the location of the blade portion 12 where the heel D contacts the bolster F.

The handle portion 14 of the knife 10 includes a tang J. The tang J is typically metal, and usually formed from the metal used to create the blade portion 12. The tang J provides structural stability to the knife 10. The handle portion 14 may additionally have scales K. The scales K are typically provided on both sides of the tang J and provide a location for a user to grasp the handle portion 14. The scales K may be made of plastic, wood, composites, or other materials. The scales K are attached to the tang J via rivets L. As shown in FIG. 1, three rivets L are provided. A handle guard M may also be provided at a proximal end of the handle portion 14. The handle guard M provides a lip that helps prevent a user's hand from slipping off of the proximal end of the handle portion 14. Finally a butt N is formed at the proximal end of the handle portion 14. The handle guard M is typically disposed below and slightly distally of the butt N.

Thus, it can be seen from the chef's knife 10, that a user is encouraged to keep their hand between the handle guard M and the bolster F, based on the shape of the knife 10. However, cooking professionals, such as chefs, often grip a knife partially forward of the bolster F. Holding the knife in such a manner allows the cooking professional to better control the blade portion 12. Many non-professionals do not realize that a knife can be held in such a manner, or are afraid to hold a knife in such a manner for fear of being cut. Therefore, a need exists for a knife that is ergonomically designed to position a user's hand to a position that allows better control of a blade portion of the knife.

SUMMARY

According to one embodiment, a knife for cutting food products comprises a blade portion, a handle portion, and a bolster. The blade portion has a cutting edge and a spine. The spine is disposed on a top side of the blade portion and generally opposed to the cutting edge. The handle portion is disposed proximal of the blade portion. The bolster has at least a first thickness and is positioned between the blade portion and the handle portion. The bolster comprises a first generally curved-shape proximal boundary and a second generally curved-shaped distal boundary. The bolster has a first lateral sidewall and a second lateral sidewall. A surface depression is disposed between the first generally curved-shape proximal boundary and the second generally curved-shape distal boundary of at least one of the first lateral sidewall and the second lateral sidewall. The first generally curved-shape proximal boundary is spaced a distance from the second generally curved-shape distal boundary to receive a thumb of a user on the bolster.

According to another embodiment, a knife for cutting comprises a blade portion, a handle portion, and a bolster. The blade portion has a cutting edge and a spine. The spine is disposed on a top side of the blade portion and generally opposed to the cutting edge. The handle portion is disposed proximal of the blade portion. The bolster has at least a first thickness and is positioned between the blade portion and the handle portion. The bolster comprises a first proximal boundary and a second distal boundary. The bolster has a first lateral sidewall and a second lateral sidewall. A surface depression is disposed between the first proximal boundary and the second distal boundary of at least one of the first lateral sidewall and the second lateral sidewall. The first proximal boundary is spaced a distance from the second distal boundary to receive a thumb of a user on the bolster.

According to one process, a method of grasping a knife for slicing is provided. The knife has a blade portion, a handle portion, and a bolster positioned between the blade portion and the handle portion. The bolster has a generally arc shape and a generally blunt bottom surface. A thumb of a first hand is placed on a first side of a bolster. An index finger of the first hand is placed on a second side of the bolster. The second side of the bolster is opposite of the first side of the bolster. The index finger contacts a blunt surface of the bolster. At least one of the remaining fingers of the first hand wraps around a handle portion of the knife.

BRIEF DESCRIPTION OF DRAWINGS

To understand the present disclosure, it will now be described by way of example, with reference to the accompanying Appendix containing drawings in which.

DETAILED DESCRIPTION

Figure 1:
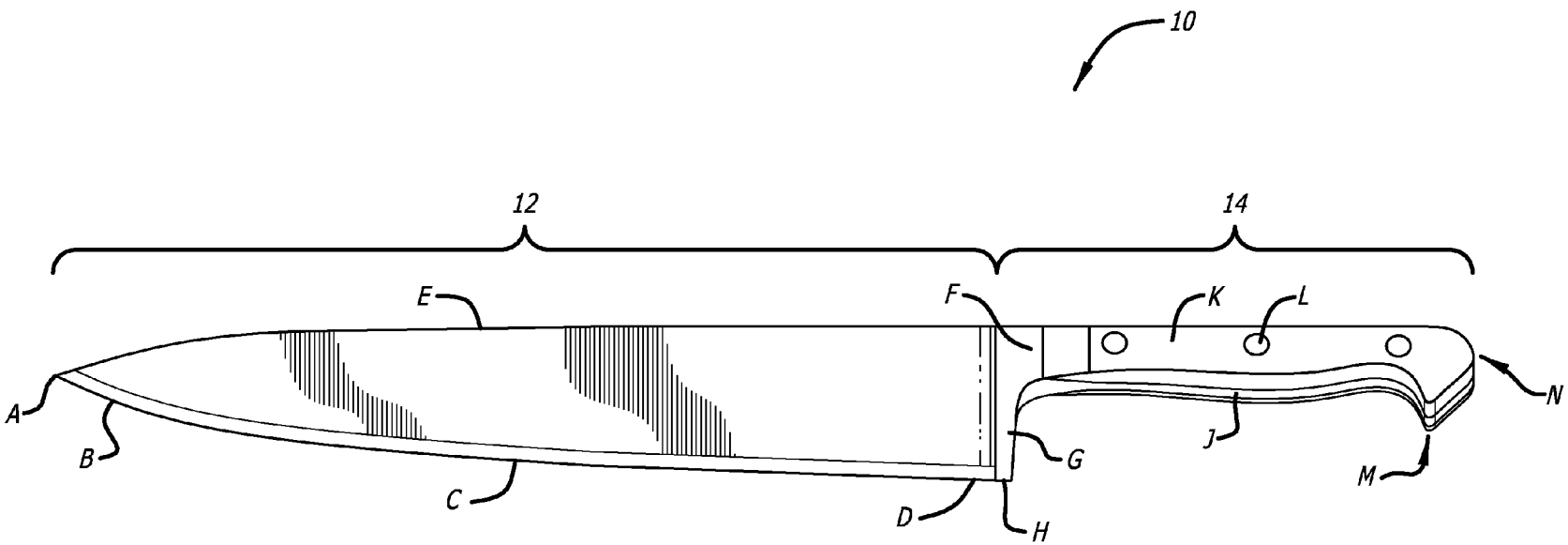
FIG. 1 (Prior Art)
FIG. 1 is a side view of a prior art knife.

While this disclosure is susceptible of embodiments in many different forms, there is shown in the drawings and will herein be described in detail preferred examples of the disclosure with the understanding that the present disclosure is to be considered an exemplification of the principles contained herein and is not intended to limit the broad aspects disclosed to the examples illustrated.

Figure 2:
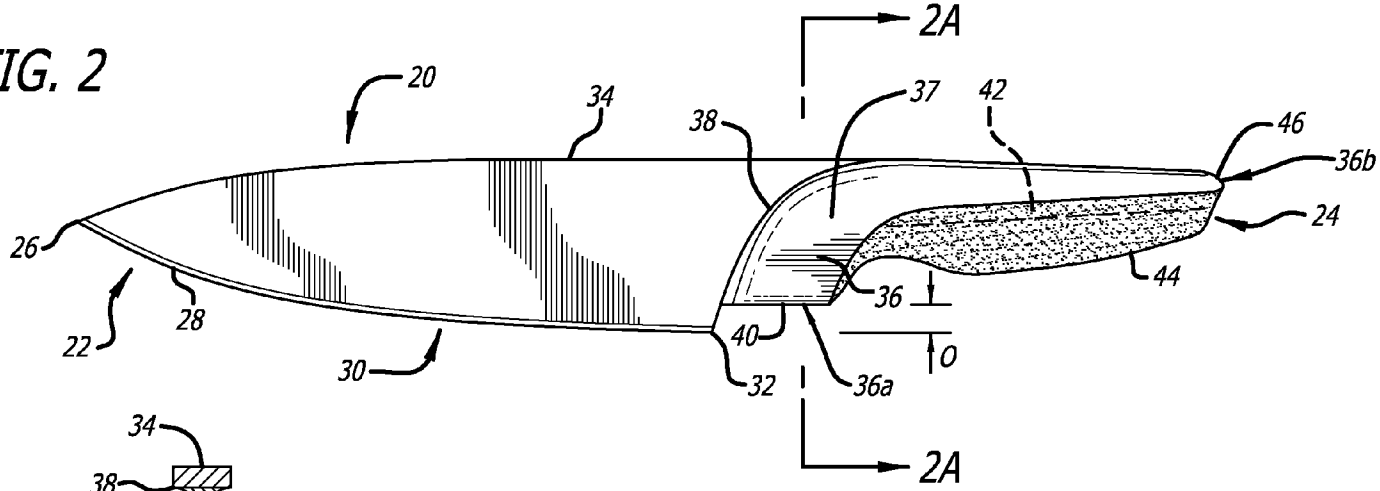
FIG. 2 is a side view of a knife according to one embodiment.
Figure 2A:
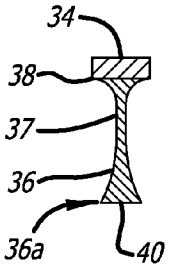
FIG. 2A is a cross-sectional view of the knife of FIG. 2 taken along the line 2A-2A.

Referring now to FIG. 2, a knife 20 is shown. The knife 20 is in the form of a chefs knife. The knife 20 has a blade portion 22 and a handle portion 24. The blade portion 22 has a point 26 located at a distal end of the blade portion 22. The blade portion 22 additionally has a tip region 28. The tip region 28 is curved to allow a user to perform more delicate cutting operations. The blade portion 22 further comprises a cutting edge 30 on a first side of the blade portion. The cutting edge 30 is a sharpened cutting surface utilized to cut food products being prepared by the user. The cutting edge 30 runs from the point 26 to a heel 32. The heel 32 is located generally at a proximal end of the blade portion 22.

The blade portion 22 additionally comprises a spine 34. The spine 34 extends along the blade portion 22 on a generally opposite side of the cutting edge 30. The spine 34 provides structural rigidity and weight to the blade portion 22.

The knife 20 additionally has a bolster 36. The bolster 36 marks a transition between the blade portion 22 and the handle portion 24. The bolster 36 as shown in FIG. 2 has an arc shape or curved shape that resembles an inverted "L." The bolster 36 has a distal boundary 36*a* and a proximal boundary 36*b*. The distal boundary 36*a* has an arcuate shape or a curved shape, and the proximal boundary 36*b* additionally has an arcuate shape or a curved shape that provides the bolster 36 with the arcuate shape or curved shape.

The bolster 36 additionally has a surface depression 37 formed in at least one of a first lateral sidewall or a second lateral sidewall of the bolster 36. The surface depression 37 reduces the thickness of a portion of the bolster 36 and provides a visual cue to the user as to where to position a finger on the bolster. The depression 37 additionally assists the user in maintaining a grip on the bolster 36.

Figure 3:
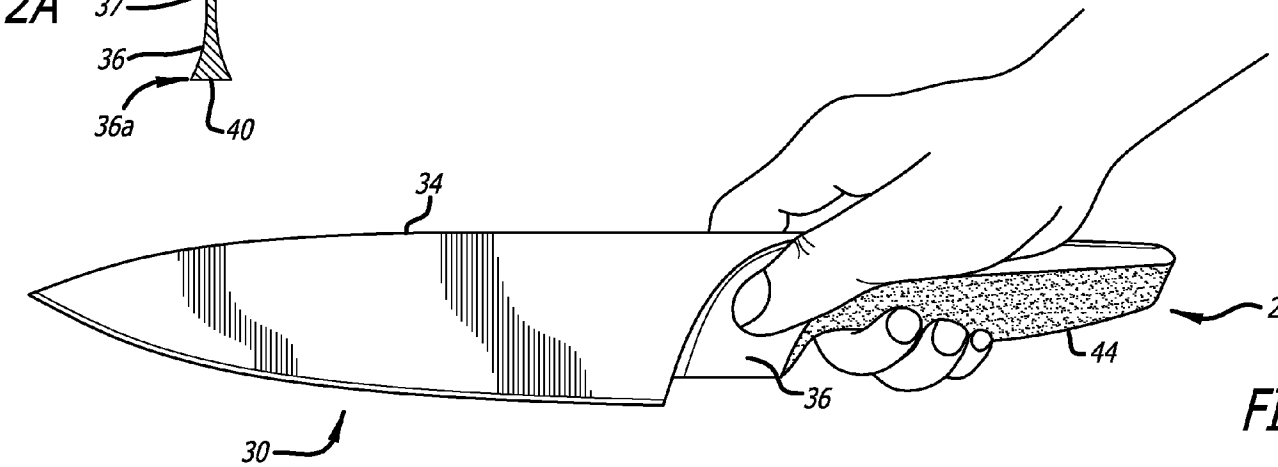
FIG. 3 is a side view the knife of FIG. 2 being held in a first position.

The arc shape or curved shape of the bolster 36 encourages a user to position their thumb and forefinger on the bolster 36. The shape of the bolster 36 naturally positions a person's thumb and index finger to a "pinch" grip as shown in FIG. 3. By holding the knife 20 with a "pinch" grip, a user may better control the blade portion 22, as the user is gripping the knife closer to the blade portion 22. The "pinch" grip is well suited for activities such as slicing vegetables, slicing fruits, slicing meats, and other activities where control of the blade portion 22 is desired. The bolster 36 is disposed nearer the distal end of the knife 20, i.e., nearer the point 26 of the blade portion 22, than the bolster F of the conventional knife 10 of FIG. 1.

The knife 20 comprises a finger guard 38. The finger guard 38 protrudes transversely from the blade portion at a distal end of the bolster 36. The finger guard 38 is provided to help prevent a user's hand from slipping onto the blade portion 22. The finger guard 38 has a generally identical arc shape or curve shape that resembles an inverted "L" as the bolster 36. The finger guard 38 additionally provides a visual indication to a user that it is acceptable to position their hand closer to the blade portion 22. The finger guard 38 is disposed nearer the distal end of the knife 20, i.e., nearer the point 26 of the blade portion 22, than the finger guard G of the conventional knife 10 of FIG. 1.

The bolster 36 additionally has a blunt edge 40. The blunt edge 40 is offset a distance O from the edge 30 of the knife 20. The offset O is selected such that a user's index finger may contact the blunt edge 40, rather than the cutting edge 30, reducing the likelihood of a user cutting their finger while using a "pinch" grip as shown in FIG. 3.

It is contemplated that the thickness of the bolster 36 may vary from the handle portion 24 towards the blade portion 22, with the thickness of the bolster being greatest near the handle portion 24, and thinnest near the blade portion 22 or the blunt edge 40. The thinning of the bolster 36 encourages a user to place their thumb and index finger on the bolster 36 to form a "pinch" grip.

It is further contemplated that the bolster 36 may be provided with recesses, not shown, to provide a user with a more certain location to place their thumb and index finger on the bolster 36. The user would place their thumb in a recess on a first lateral side of the bolster 36, and their index finger in a recess on an opposite side of the bolster 36.

The handle portion 24 of the knife 20 has a tang 42 that is made from the same material as the blade portion 22. The tang 42 has a grip 44 attached thereto. The grip 44 may be attached to the tang 42 in a variety of manners, such as through the use of fasteners, via an adhesive, or other known connecting mechanisms. The grip 44 may be formed of a variety of materials that provide a user with enhanced grip, such as polymeric materials, silicone, rubber, and the like. It is additionally contemplated that a grip and a tang may be a single piece of metal, thus making an entire knife from one piece of metal. The handle portion 24 terminates in a butt 46 at a proximal end of the knife 20.

As previously mentioned above, FIG. 3 shows the knife 20 being held in "pinch" grip by a user. In a "pinch" grip, the user places their thumb on one side of the bolster 36 and their index finger on the other side of bolster 36, thereby "pinching" the knife 20 between their thumb and index finger. The remainder of the user's hand wraps around the grip 44 and the tang 42 of the handle portion 24. Thus, the user's hand is positioned closer to the blade portion 22 than the conventional knife 10 contemplates assuming the user positions their hand toward the handle portion 12 side of the bolster F and finger guard G. Positioning a user's hand closer to the blade portion 22 allows a user to have better control of the knife 20 and use the knife 20 in a more precise manner when slicing and cutting objects.

Figure 4:
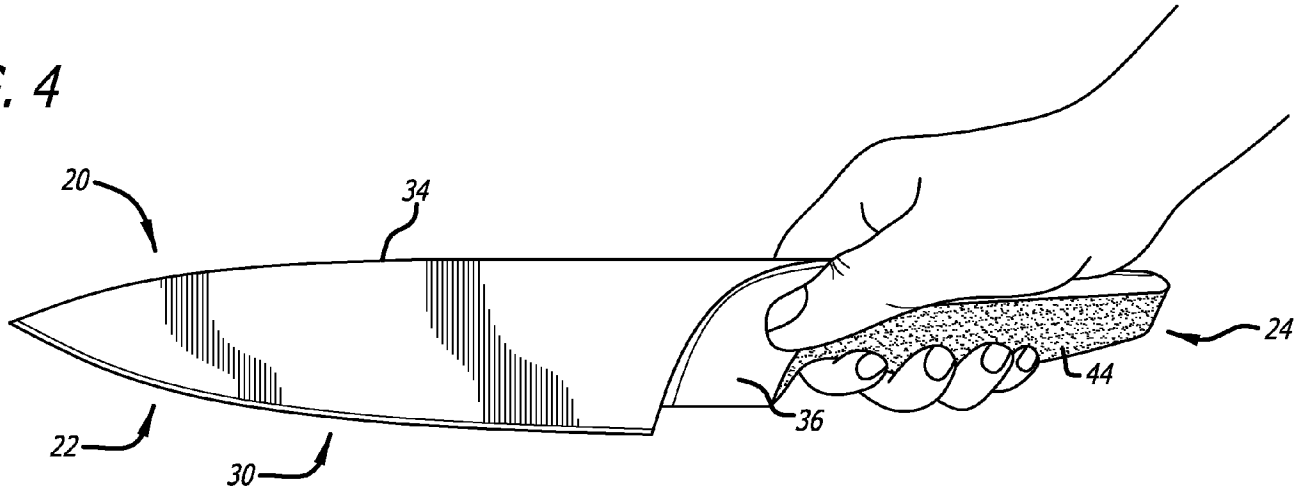
FIG. 4 is a side view of the knife of FIG. 2 being held in a second position.

FIG. 4 shows a user's hand with a "grasp" type grip of the knife 20. In a "grasp" grip, the user places their thumb on one side of the bolster 36, and wraps their fingers around the handle portion 24 of the knife 20. The "grasp" grip is how many non-professionals typically hold a knife. A grasp grip is useful for chopping materials with the knife 20. Even when utilizing the "grasp" type grip shown in FIG. 4, the user's hand is still closer to the blade portion 22 than a similar grip would provide on the conventional knife 10. Hence, the user will again be better able to control the blade portion 22 of the knife 20 when using a "grasp" type grip.

Figure 5:
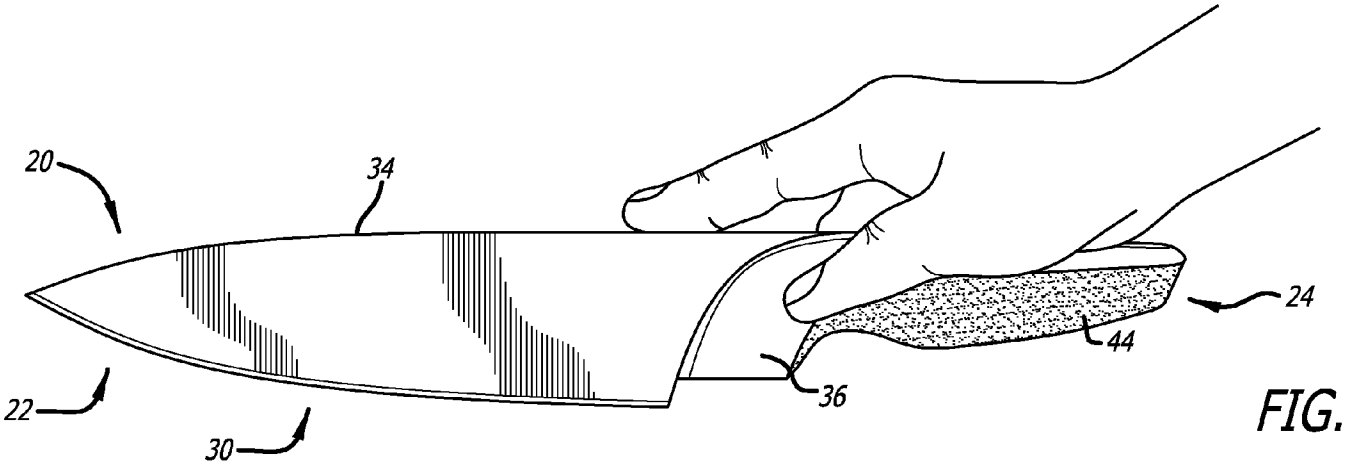
FIG. 5 is a side view of the knife of FIG. 2 being held in a third position; handle according to one embodiment.

FIG. 5 shows a "pare" type grip. A "pare" type grip is utilized most typically when a user is performing a peeling type task, such as peeling the skin from an apple or carrot, or other similar cutting operations. In the "pare" type grip the user's thumb contacts the bolster 36, while the user's index finger extends along the spine 34 of the knife 20. The remainder of the user's fingers are wrapped around the handle portion 24 of the knife 20. The extension of the user's index finger along the spine 34 stabilizes the movement of the blade portion 24. The positioning of the thumb on the bolster 36 provides enhanced stability of the knife 20 relative to the conventional knife 10, as the user's thumb is closer to the blade portion 22, thereby giving the user more control over the blade portion 22.

Figure 6:
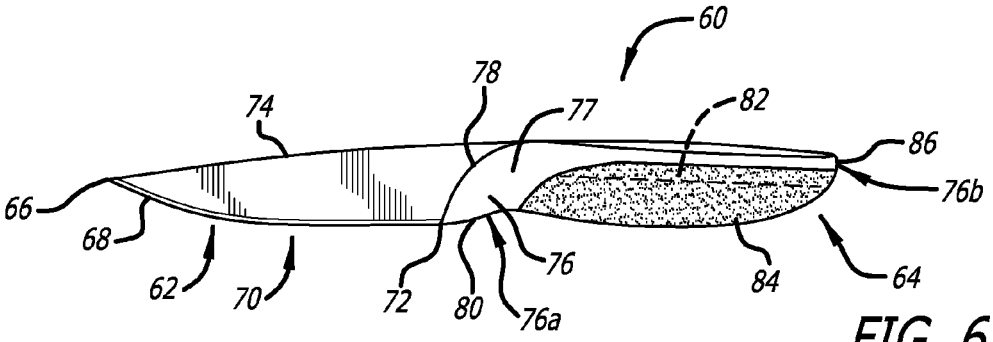
FIG. 6 is a side view of a knife according to another embodiment.

Referring next to FIG. 6, a knife 60 is shown. The knife 60 is in the form of a steak knife. The knife 60 has a blade portion 62 and a handle portion 64. The blade portion 62 has a point 66 located at a distal end of the blade portion 62. The blade portion 62 additionally has a tip region 68. The tip region 68 is curved to allow a user to perform more delicate cutting operations. The blade portion 62 further comprises a cutting edge 70 on a first side of the blade portion 62. The cutting edge 70 is a sharpened cutting surface utilized to cut food products being prepared by the user. The cutting edge 70 runs from the point 66 to a heel 72. The heel 72 is located generally at a proximal end of the blade portion 62.

The blade portion 62 additionally comprises a spine 74. The spine 74 extends along the blade portion 62 on a generally opposite side of the cutting edge 70. The spine 74 provides structural rigidity and weight to the blade portion 62.

The knife 60 additionally has a bolster 76. The bolster 76 marks a transition between the blade portion 62 and the handle portion 64. The bolster 76 as shown in FIG. 2 has an arcuate shape or curved shape that resembles an inverted "L." The bolster 76 has a distal boundary 76*a* and a proximal boundary 76*b*. The distal boundary 76*a* has an arcuate shape or a curved shape, and the proximal boundary additionally has an arcuate shape or a curved shape that provides the bolster 76 with the arcuate shape or curved shape.

The bolster 76 additionally has a surface depression 77 formed in at least one of a first lateral sidewall or a second lateral sidewall of the bolster 76. The surface depression 77 reduces the thickness of a portion of the bolster 76 and provides a visual cue to the user as to where to position a finger on the bolster. The depression 77 additionally assists the user in maintaining a grip on the bolster 76.

Figure 7:
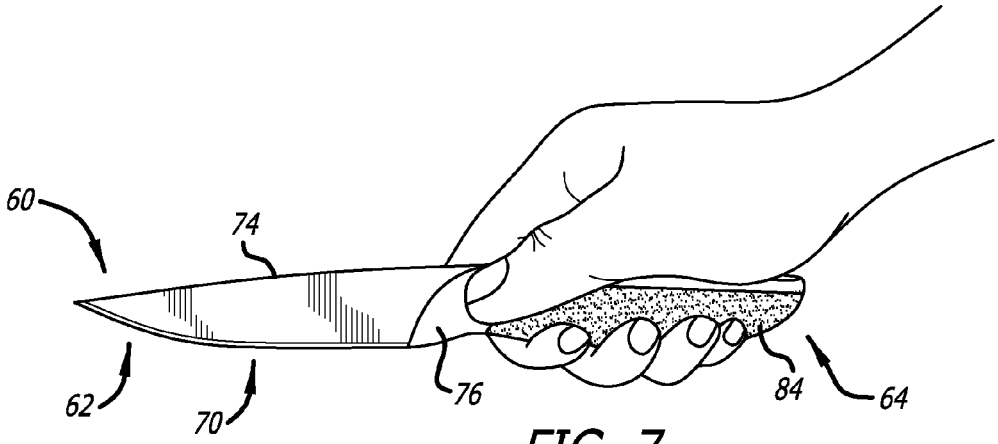
FIG. 7 is a side view of the knife of FIG. 6 being held in a first position.

The arcuate shape or curved shape of the bolster 76 additionally encourages a user to position their thumb on the bolster 76. The shape of the bolster 76 naturally positions a user's thumb and index finger to a "grasp" grip as shown in FIG. 7. By holding the knife 60 with a "grasp" grip, a user may better control the blade portion 62, as the user is gripping the knife closer to the blade portion 62. The bolster 76 is disposed nearer the distal end of the knife 60, i.e., nearer the point 66 of the blade portion 62, than the bolster F of the conventional knife 10 of FIG. 1.

The knife 60 comprises a finger guard 78. The finger guard 78 protrudes transversely from the blade portion 62 at a distal end of the bolster 76. The finger guard 78 is provided to help prevent a user's hand from slipping onto the blade portion 72. The finger guard 78 has a generally identical arc shape or curve shape that resembles an inverted "L" as the bolster 76. The finger guard 78 additionally is proved to provide a visual indication to a user that it is acceptable to position their hand closer to the blade portion 62. The finger guard 78 is disposed nearer the distal end of the knife 60, i.e., nearer the point 66 of the blade portion 62, than the finger guard G of the conventional knife 10 of FIG. 1.

The bolster 76 additionally has a blunt edge 80. The blunt edge 80 is provided so that a user's index finger may contact the blunt edge 80, rather than the cutting edge 70, reducing the likelihood of a user cutting their finger while using a "grasp" grip as shown in FIG. 7.

It is contemplated that the thickness of the bolster 76 may vary from the handle portion 64 towards the blade portion 62, with the thickness of the bolster 76 being greatest near the handle portion 64, and thinnest near the blade portion 62 or the blunt edge 80. The thinning of the bolster 76 encourages a user to place their thumb on the bolster 76.

It is further contemplated that the bolster 76 may be provided with recesses, not shown, to provide a user with a more certain location to place their thumb on the bolster 76. The user would place their thumb in a recess on a first lateral side of the bolster 76.

The handle portion 64 of the knife 60 has a tang 82 that is made from the same material as the blade portion 62. The tang 82 has a grip 84 attached thereto. The grip 84 may be attached to the tang 82 in a variety of manners, such as through the use fasteners, via an adhesive, or other known connecting mechanisms. The grip 84 may be formed of a variety of materials that provide a user with enhanced grip, such as polymeric materials, silicone, rubber, and the like. It is additionally contemplated that a grip and a tang may be a single piece of metal, thus making an entire knife from one piece of metal. The handle portion 64 terminates in a butt 86 at a proximal end of the knife 60.

FIG. 7 shows a user's hand with a "grasp" type grip of the knife 60. In a "grasp" grip, the user places their thumb on one side of the bolster 76, and wraps their fingers around the handle portion 64 of the knife 60. The "grasp" grip is how many non-professionals typically hold a knife. A grasp grip is useful for chopping and slicing materials with the knife 60. Even when utilizing the "grasp" type grip shown in FIG. 7, the user's hand is still closer to the blade portion 62 than a similar grip would provide on the conventional knife 10. Hence, the user will again be better able to control the blade portion 62 of the knife 60 when using a "grasp" type grip.

Figure 8:
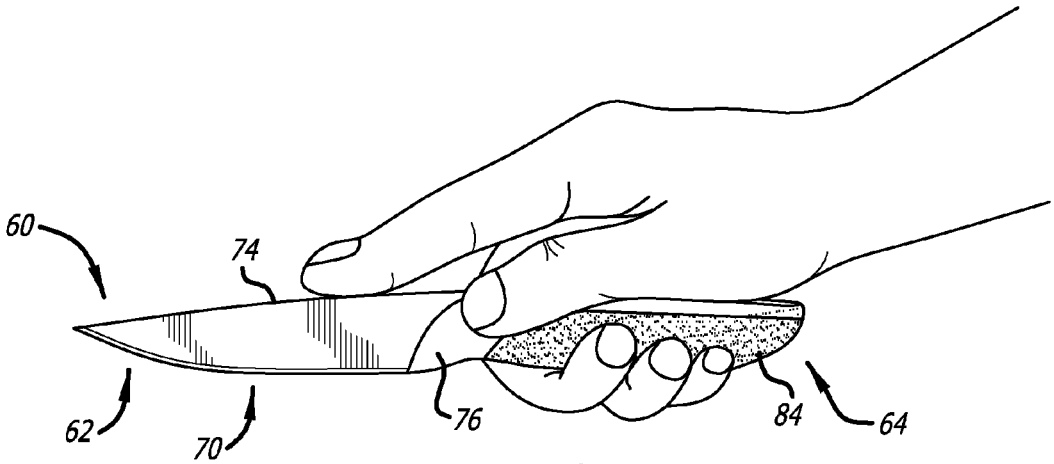
FIG. 8 is a side view of the knife of FIG. 6 being held in a second position.

FIG. 8 shows a "pare" type grip. A "pare" type grip is utilized most typically when a user is performing a more precise task, such as cutting meat away from a bone, or other similar cutting operations. In the "pare" type grip the user's thumb contacts the bolster 76, while the user's index finger extends along the spine 74 of the knife 60. The remainder of the user's fingers are wrapped around the handle portion 64 of the knife 60. The extension of the user's index finger along the spine 74 stabilizes the movement of the blade portion 62. The positioning of the thumb on the bolster 76 provides enhanced stability of the knife 60 relative to the conventional knife 10, as the user's thumb is closer to the blade portion 62, thereby giving the user more control over the blade portion 62.

Figure 9:
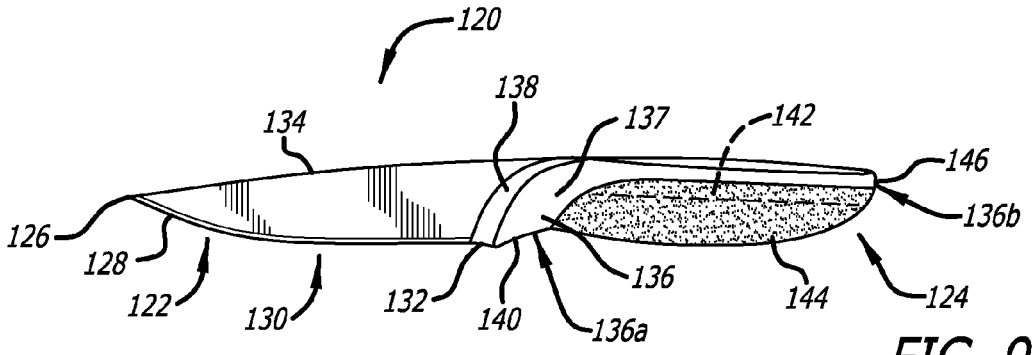
FIG. 9 is a side view of a knife according to a further embodiment.

FIG. 9 shows a knife 120. The knife 120 is in the form of a paring knife. The knife 120 has a blade portion 122 and a handle portion 124. The blade portion 122 has a point 126 located at a distal end of the blade portion 122. The blade portion 122 additionally has a tip region 128. The tip region 128 is curved to allow a user to perform more delicate cutting operations. The blade portion 122 further comprises a cutting edge 130 on a first side of the blade portion. The cutting edge 130 is a sharpened cutting surface utilized to cut food products being prepared by the user. The cutting edge 130 runs from the point 126 to a heel 132. The heel 132 is located generally at a proximal end of the blade portion 122.

The blade portion 122 additionally comprises a spine 134. The spine 134 extends along the blade portion 122 on a generally opposite side of the cutting edge 130. The spine 134 provides structural rigidity and weight to the blade portion 122.

The knife 120 additionally has a bolster 136. The bolster 136 marks a transition between the blade portion 122 and the handle portion 124. The bolster 136 as shown in FIG. 9 has an arc shape or curved shape that resembles an inverted "L." The bolster 136 has a distal boundary **136*a* and a proximal boundary 136*b*. The distal boundary 136*a* has an arcuate shape or a curved shape, and the proximal boundary 136*b* additionally has an arcuate shape or a curved shape that provides the bolster 136** with the arcuate shape or curved shape.

The bolster 136 additionally has a surface depression 137 formed in at least one of a first lateral sidewall or a second lateral sidewall of the bolster 136. The surface depression 137 reduces the thickness of a portion of the bolster 136 and provides a visual cue to the user as to where to position a finger on the bolster. The depression 137 additionally assists the user in maintaining a grip on the bolster 136.

The arcuate shape or curved shape of the bolster 136 encourages a user to position their thumb on the bolster 136. The bolster 136 is disposed nearer the distal end of the knife 120, i.e., nearer the point 126 of the blade portion 122, than the bolster F of the conventional knife 10 of FIG. 1.

The knife 120 comprises a finger guard 138. The finger guard 138 protrudes transversely from the blade portion at a distal end of the bolster 136. The finger guard 138 is provided to help prevent a user's hand from slipping onto the blade portion 122. The finger guard 138 has a generally identical arc shape or curve shape that resembles an inverted "L" as the bolster 136. The finger guard 138 additionally provides a visual indication to a user that it is acceptable to position their hand closer to the blade portion 122. The finger guard 138 is disposed nearer the distal end of the knife 120, i.e., nearer the point 126 of the blade portion 122, than the finger guard G of the conventional knife 10 of FIG. 1.

The bolster 136 additionally has a blunt edge 140, reducing the likelihood of a user cutting their finger.

It is contemplated that the thickness of the bolster 136 may vary from the handle portion 124 towards the blade portion 122, with the thickness of the bolster being greatest near the handle portion 124, and thinnest near the blade portion 122 or the blunt edge 140. The thinning of the bolster 136 encourages a user to place their thumb on the bolster 136.

It is further contemplated that the bolster 136 may be provided with recesses, not shown, to provide a user with a more certain location to place their thumb on the bolster 136. The user would place their thumb in a recess on a first lateral side of the bolster 136.

The handle portion 124 of the knife 120 has a tang 142 that is made from the same material as the blade portion 122. The tang 142 has a grip 144 attached thereto. The grip 144 may be attached to the tang 142 in a variety of manners, such as through the use of fasteners, via an adhesive, or other known connecting mechanisms. The grip 144 may be formed of a variety of materials that provide a user with enhanced grip, such as polymeric materials, silicone, rubber, and the like. It is additionally contemplated that a grip and a tang may be a single piece of metal, thus making an entire knife from one piece of metal. The handle portion 124 terminates in a butt 146 at a proximal end of the knife 120.

Figure 10:
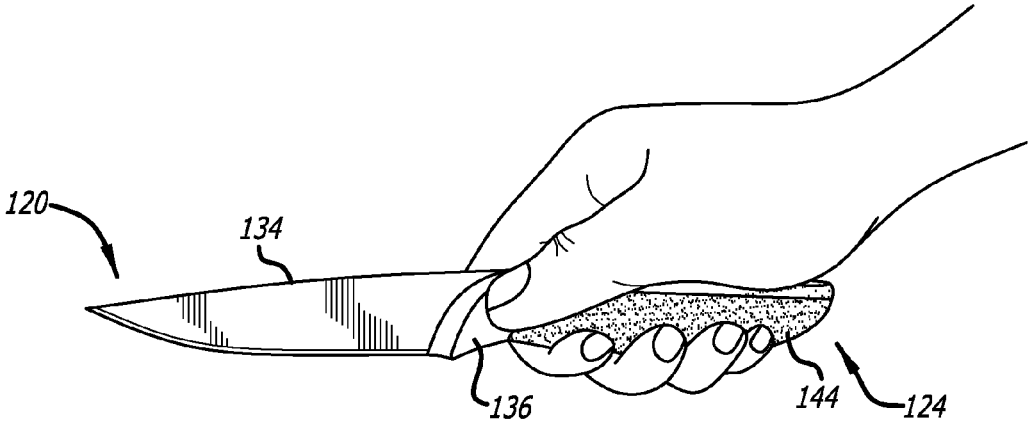
FIG. 10 is a side view of the knife of FIG. 9 being held in a first position.

FIG. 10 shows a user's hand with a "grasp" type grip of the knife 120. In a "grasp" grip, the user places their thumb on one side of the bolster 136, and wraps their fingers around the handle portion 124 of the knife 120. The "grasp" grip is how many non-professionals typically hold a knife. A grasp grip is useful for chopping materials with the knife 120. Even when utilizing the "grasp" type grip shown in FIG. 10, the user's hand is still closer to the blade portion 122 than a similar grip would provide on the conventional knife 10. Hence, the user will again be better able to control the blade portion 122 of the knife 120 when using a "grasp" type grip.

Figure 11:
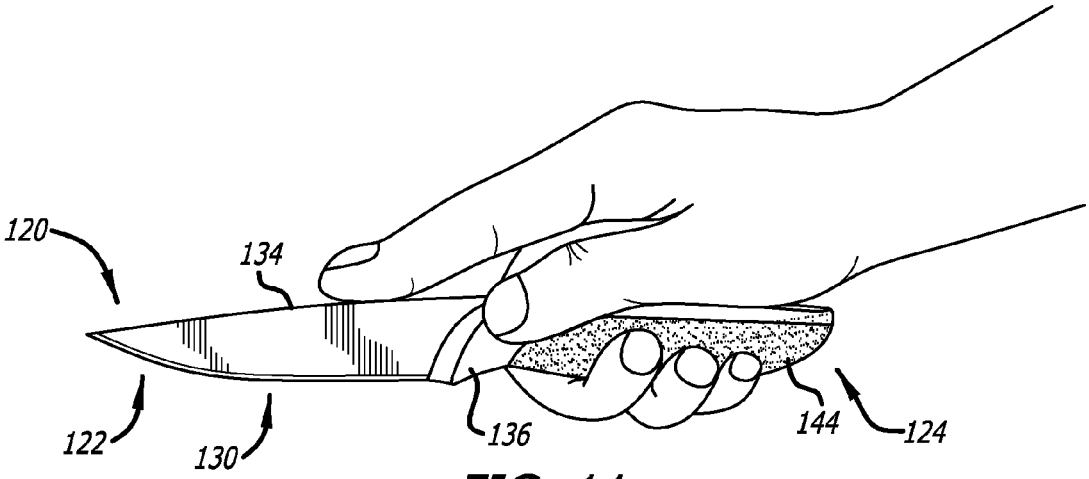
FIG. 11 is a side view of the knife of FIG. 9 being held in a second position.

FIG. 11 shows a "pare" type grip. A "pare" type grip is utilized most typically when a user is performing a peeling type task, such as peeling the skin from an apple or carrot, or other similar cutting operations. In the "pare" type grip the user's thumb contacts the bolster 136, while the user's index finger extends along the spine 134 of the knife 120. The remainder of the user's fingers are wrapped around the handle portion 124 of the knife 120. The extension of the user's index finger along the spine 134 stabilizes the movement of the blade portion 124. The positioning of the thumb on the bolster 136 provides enhanced stability of the knife 120 relative to the conventional knife 10, as the user's thumb is closer to the blade portion 122, thereby giving the user more control over the blade portion 122.

Figure 12:
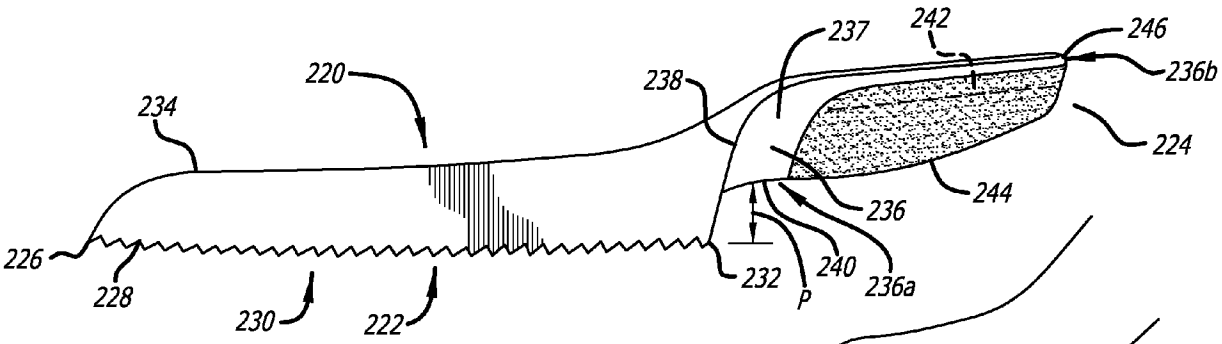
FIG. 12 is a side view of a knife according to yet another embodiment.

Finally, FIG. 12 shows a knife 220. The knife 220 is in the form of a bread knife. The knife 220 has a blade portion 222 and a handle portion 224. The blade portion 222 has a point 226 located at a distal end of the blade portion 222. The blade portion 222 additionally has a tip region 228. The tip region 228 is curved to allow a user to perform more delicate cutting operations. The blade portion 222 further comprises a cutting edge 230 on a first side of the blade portion. The cutting edge 230 is a sharpened cutting surface utilized to cut food products being prepared by the user. The cutting edge 230 runs from the point 226 to a heel 232. The heel 232 is located generally at a proximal end of the blade portion 222. As shown in FIG. 12, the cutting edge 230 is a serrated cutting edge.

The blade portion 222 additionally comprises a spine 234. The spine 234 extends along the blade portion 222 on a generally opposite side of the cutting edge 230. The spine 234 provides structural rigidity and weight to the blade portion 222.

The knife 220 additionally has a bolster 236. The bolster 236 marks a transition between the blade portion 222 and the handle portion 224. The bolster 236 as shown in FIG. 12 has an arc shape or curved shape that resembles an inverted "L." The bolster 236 has a distal boundary **236*a* and a proximal boundary 236*b*. The distal boundary 236*a* has an arcuate shape or a curved shape, and the proximal boundary 236*b*** additionally has an arcuate shape or a curved shape that provides the bolster 236 with the arcuate shape or curved shape.

The bolster 236 additionally has a surface depression 237 formed in at least one of a first lateral sidewall or a second lateral sidewall of the bolster 236. The surface depression 237 reduces the thickness of a portion of the bolster 236 and provides a visual cue to the user as to where to position a finger on the bolster. The depression 237 additionally assists the user in maintaining a grip on the bolster 236.

The arcuate shape or curved shape of the bolster 236 encourages a user to position their thumb on the bolster 236. The bolster 236 is disposed nearer the distal end of the knife 220, i.e., nearer the point 226 of the blade portion 222, than the bolster F of the conventional knife 10 of FIG. 1.

The knife 220 comprises a finger guard 238. The finger guard 238 protrudes transversely from the blade portion at a distal end of the bolster 236. The finger guard 238 is provided to help prevent a user's hand from slipping onto the blade portion 222. The finger guard 238 has a generally identical arc shape or curve shape that resembles an inverted "L" as the bolster 236. The finger guard 238 additionally provides a visual indication to a user that it is acceptable to position their hand closer to the blade portion 222. The finger guard 238 is disposed nearer the distal end of the knife 220, i.e., nearer the point 126 of the blade portion 122, than the finger guard G of the conventional knife 10 of FIG. 1.

The bolster 236 additionally has a blunt edge 240. The blunt edge 240 is offset a distance P from the cutting edge 230. The distance P is selected to allow a user to grasp the handle portion 224 and not have their hand contact a surface where bread, or another item being cut, is located. The blunt edge 240 reduces the likelihood of a user cutting their finger.

It is contemplated that the thickness of the bolster 236 may vary from the handle portion 224 towards the blade portion 222, with the thickness of the bolster being greatest near the handle portion 224, and thinnest near the blade portion 222 or the blunt edge 240. The thinning of the bolster 236 encourages a user to place their thumb on the bolster 236.

It is further contemplated that the bolster 236 may be provided with recesses, not shown, to provide a user with a more certain location to place their thumb on the bolster 236. The user would place their thumb in a recess on a first lateral side of the bolster 236.

The handle portion 224 of the knife 220 has a tang 242 that is made from the same material as the blade portion 222. The tang 242 has a grip 244 attached thereto. The grip 244 may be attached to the tang 242 in a variety of manners, such as through the use of fasteners, via an adhesive, or other known connecting mechanisms. The grip 244 may be formed of a variety of materials that provide a user with enhanced grip, such as polymeric materials, silicone, rubber, and the like. It is additionally contemplated that a grip and a tang may be a single piece of metal, thus making an entire knife from one piece of metal. The handle portion 224 terminates in a butt 246 at a proximal end of the knife 220.

Figure 13:
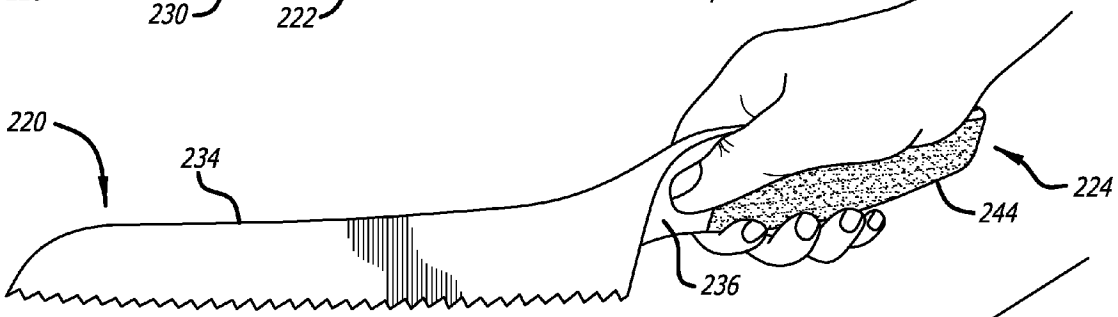
FIG. 13 is a side view of the knife of FIG. 12 being held in a first position.

FIG. 13 shows a user's hand with a "grasp" type grip of the knife 220. In a "grasp" grip, the user places their thumb on one side of the bolster 236, and wraps their fingers around the handle portion 224 of the knife 220. The "grasp" grip is how many non-professionals typically hold a knife. A grasp grip is useful for chopping materials with the knife 220. Even when utilizing the "grasp" type grip shown in FIG. 13, the user's hand is still closer to the blade portion 222 than a similar grip would provide on the conventional knife 10. Hence, the user will again be better able to control the blade portion 222 of the knife 220 when using a "grasp" type grip.

Figure 14:
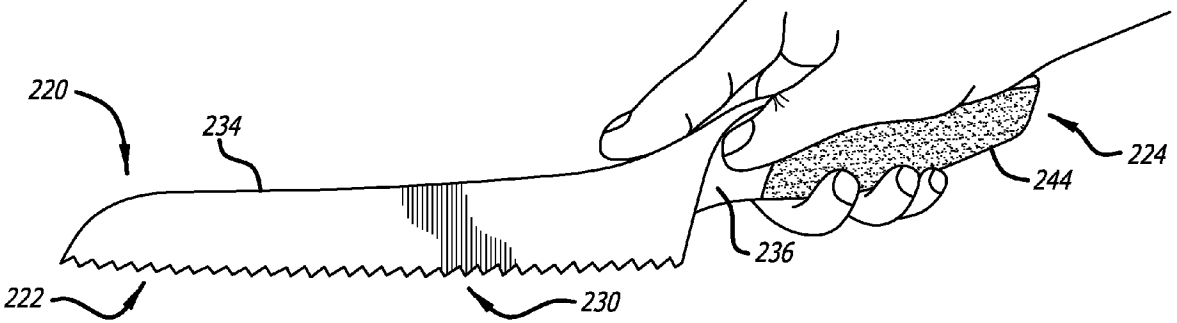
FIG. 14 is a side view of the knife of FIG. 12 being held in a second position.
Figure 15:
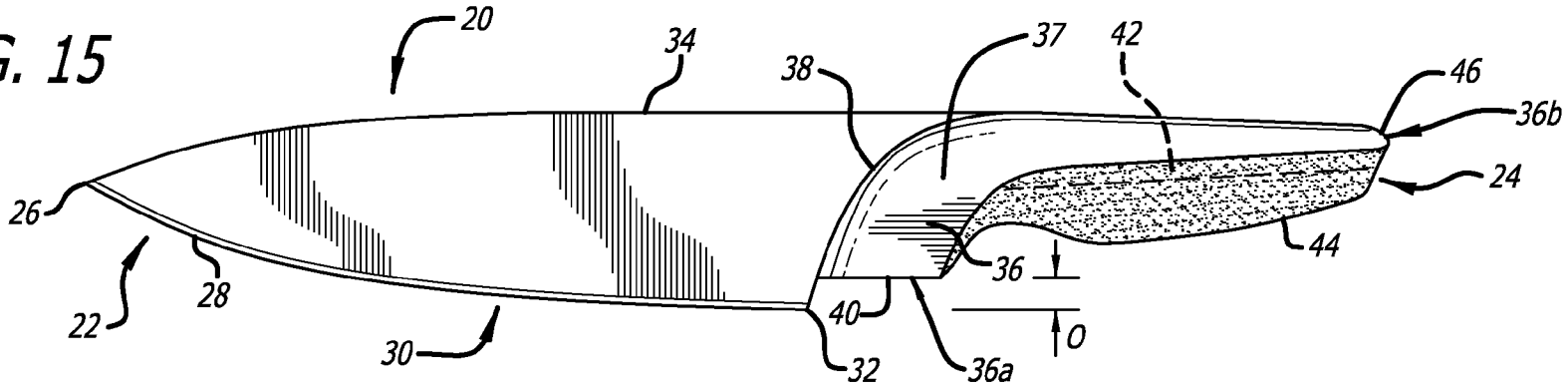
FIG. 15 is a side view of a knife according to another embodiment of the present invention.

FIG. 14 shows a "pare" type grip. In the "pare" type grip the users thumb contacts the bolster 236, while the user's index finger extends along the spine 234 of the knife 220. The remainder of the user's fingers are wrapped around the handle portion 224 of the knife 220. The extension of the user's index finger along the spine 234 stabilizes the movement of the blade portion 224. The positioning of the thumb on the bolster 236 provides enhanced stability of the knife 220 relative to the conventional knife 10, as the user's thumb is closer to the blade portion 222, thereby giving the user more control over the blade portion 222.

While specific embodiments have been illustrated and described, numerous modifications come to mind without significantly departing from the spirit of the invention, and the scope of protection is only limited by the scope of the accompanying claims.

What is claimed is:

1. A knife having a proximal end, a distal end and a length defined therebetween, the knife comprising:

a blade portion having a cutting edge and a spine, the spine being disposed on a top side of the blade portion and generally opposed to the cutting edge;

a handle portion disposed proximal of the blade portion, the handle portion having a top surface and a bottom surface, a first end proximal to the blade portion and a second end distal to the blade portion;

the handle portion further comprising a bolster section, the bolster section having at least a first thickness, a first lateral sidewall and a second lateral sidewall, the bolster section being disposed at the first end of the handle portion and adjacent to the blade portion, the first sidewall of the bolster section comprising:

an arcuate proximal bolster boundary, the arcuate proximal bolster boundary being defined by a curvilinear ridge extending downwardly toward the blade portion from a point proximate the top surface of the handle portion and an arcuate distal bolster boundary, the arcuate distal bolster boundary being defined by a curvilinear ridge extending downwardly toward the blade portion from a point proximate the bottom surface of the handle portion, wherein a portion of the curvilinear ridge defining the arcuate proximal bolster boundary is spaced a distance along the length of the knife from a portion of the curvilinear ridge defining the arcuate distal boundary; and a surface depression formed in at least one of the first lateral sidewall and the second lateral sidewall, the surface depression being disposed between the curvilinear ridge defining the arcuate proximal bolster boundary.

2. The knife of claim 1, wherein the cutting edge is serrated.

3. A method of grasping a knife for slicing, the method comprising:

providing a knife having a proximal end, a distal end and a length defined therebetween, the knife comprising a blade portion having a cutting edge and a spine, the spine being disposed on a top side of the blade portion and generally opposed to the cutting edge; a handle portion disposed proximal of the blade portion, the handle portion having a top surface and a bottom surface, a first end proximal to the blade portion and a second end distal to the blade portion; the handle portion further comprising a bolster section having at least a first thickness, a first lateral sidewall and a second lateral sidewall, the bolster section being disposed at the first end of the handle portion and adjacent to the blade portion, the first sidewall of the bolster section comprising an arcuate proximal bolster boundary, the arcuate proximal bolster boundary being defined by a curvilinear ridge extending downwardly toward the blade portion from a point proximate the top surface of the handle portion and an arcuate distal bolster boundary, the arcuate distal bolster boundary being defined by a curvilinear ridge extending downwardly toward the blade portion from a point proximate the bottom surface of the handle portion, wherein a portion of the curvilinear ridge defining the arcuate proximal bolster boundary is spaced a distance along the length of the knife from a portion of the curvilinear ridge defining the arcuate distal boundary;

placing a thumb of a first hand on a first side of a bolster between the arcuate proximal bolster boundary and the arcuate distal bolster boundary;

placing an index finger of the first hand on a second side of the bolster between the proximal boundary and the distal boundary, the second side of the bolster being opposite of the first side of the bolster and contacting a blunt surface of the bolster; and wrapping at least one of the remaining fingers of the first hand around a handle portion of the knife.

4. A knife having a proximal end, a distal end and a length defined therebetween, the knife comprising:

a blade portion having a cutting edge and a spine, the spine being disposed on a top side of the blade portion and generally opposed to the cutting edge;

a handle portion disposed proximal of the blade portion, the handle portion having a top surface and a bottom surface;

a bolster portion having at least a first thickness, a first lateral sidewall and a second lateral sidewall, the bolster being disposed at a position along the length of the knife between the blade portion and the handle portion, the first sidewall of the bolster comprising:

an arcuate proximal bolster boundary, the arcuate proximal bolster boundary being defined by a curvilinear ridge extending downwardly toward the blade portion from a point proximate the top surface of the handle portion and an arcuate distal bolster boundary, the arcuate distal bolster boundary being defined by a curvilinear ridge extending downwardly toward the blade portion from a point proximate the bottom surface of the handle portion, wherein a portion of the curvilinear ridge defining the arcuate proximal bolster boundary is spaced a distance along the length of the knife from a portion of the curvilinear ridge defining the arcuate distal boundary; and a surface depression formed in at least one of the first lateral sidewall and the second lateral sidewall, the surface depression being disposed between the curvilinear ridge defining the arcuate proximal bolster boundary.

* * * * *